US012421586B2

(12) United States Patent
Lorenzino

(10) Patent No.: US 12,421,586 B2
(45) Date of Patent: Sep. 23, 2025

(54) THIN SHEETS MADE OF ALUMINIUM-COPPER-LITHIUM ALLOY FOR AIRCRAFT FUSELAGE MANUFACTURE

(71) Applicant: CONSTELLIUM ISSOIRE, Issoire (FR)

(72) Inventor: Pablo Lorenzino, Saint Cassien (FR)

(73) Assignee: CONSTELLIUM ISSOIRE, Issoire (FR)

( * ) Notice: Subject to any disclaimer, the term of this patent is extended or adjusted under 35 U.S.C. 154(b) by 739 days.

(21) Appl. No.: 16/972,236

(22) PCT Filed: May 29, 2019

(86) PCT No.: PCT/FR2019/051269

§ 371 (c)(1),
(2) Date: Dec. 4, 2020

(87) PCT Pub. No.: WO2019/234326

PCT Pub. Date: Dec. 12, 2019

(65) Prior Publication Data

US 2021/0363623 A1 Nov. 25, 2021

(30) Foreign Application Priority Data

Jun. 8, 2018 (FR) ..... 18/55005

(51) Int. Cl.
*C22F 1/057* (2006.01)
*C22C 21/16* (2006.01)

(52) U.S. Cl.
CPC ..... *C22F 1/057* (2013.01); *C22C 21/16* (2013.01)

(58) Field of Classification Search
CPC ..... C22F 1/057; C22C 21/16; C22C 21/12
(Continued)

(56) References Cited

U.S. PATENT DOCUMENTS 4,652,314 A 3/1987 Meyer
5,032,359 A 7/1991 Pickens et al.
(Continued)

FOREIGN PATENT DOCUMENTS

CN 101967588 A 2/2011
EP 0584271 A1 3/1994
(Continued)

OTHER PUBLICATIONS

Osterman, Aluminum, Springer-Verlag, Chapter 7 (Year: 1998).*
(Continued)

*Primary Examiner* — Danielle M. Carda
(74) *Attorney, Agent, or Firm* — McBee Moore & Vanik IP, LLC

(57) ABSTRACT

The invention concerns a method for manufacturing a thin sheet made of aluminium-based alloy comprising, in percent by weight, 2.3 to 2.7% Cu, 1.3 to 1.6% Li, 0.2 to 0.5% Mg, 0.1 to 0.5% Mn, 0.01 to 0.15% Ti, a quantity of Zn less than 0.3, a quantity of Fe and of Si less than or equal to 0.1% each, and unavoidable impurities at a content less than or equal to 0.05% by weight each and 0.15% by weight in total, wherein, in particular, the hot-rolling input temperature is between 400° C. and 445° C. and the hot-rolling output temperature is less than 300° C. The sheets according to the invention have advantageous mechanical properties and are used, in particular, for the manufacture of aircraft fuselage panels.

12 Claims, 2 Drawing Sheets

(58) Field of Classification Search
USPC ..... 148/552
See application file for complete search history.

(56) References Cited

U.S. PATENT DOCUMENTS

| | | | | |
|---|---|---|---|---|
| 5,455,003 | A | 10/1995 | Pickens et al. | |
| 7,229,509 | B2 | 6/2007 | Cho | |
| 7,438,772 | B2 | 10/2008 | Rioja et al. | |
| 10,836,464 | B2 | 11/2020 | Bayona-Carrillo | |
| 2007/0181229 | A1 | 8/2007 | Bes et al. | |
| 2009/0084474 | A1 | 4/2009 | Cheong et al. | |
| 2011/0247730 | A1 | 10/2011 | Yanar et al. | |
| 2015/0203941 | A1* | 7/2015 | Seki | C22C 21/00 148/692 |
| 2016/0053357 | A1* | 2/2016 | Bes | C22C 21/16 148/552 |
| 2016/0304995 | A1* | 10/2016 | Sigli | B22D 7/005 |
| 2018/0347016 | A1* | 12/2018 | Ratchev | C22F 1/043 |

FOREIGN PATENT DOCUMENTS

| | | | | |
|---|---|---|---|---|
| EP | 1891247 | A1 | 2/2008 | |
| EP | 1966402 | A1 | 9/2008 | |
| EP | 3077559 | A2 | 10/2016 | |
| FR | 3004197 | A1 * | 10/2014 | C22C 21/14 |
| FR | 3014448 | A1 | 6/2015 | |
| FR | 3044326 | A1 * | 6/2017 | C22C 21/02 |
| WO | 92/20830 | A1 | 11/1992 | |
| WO | 2006131627 | A1 | 12/2006 | |
| WO | 2007080267 | A1 | 7/2007 | |
| WO | 2015082779 | A3 | 8/2015 | |

OTHER PUBLICATIONS

ASM Handbook, "Wrought Aluminum Processes and Products" (Year: 2018).*

PCT International Search Report for PCT/FR2019/051269, mailed Sep. 16, 2019.

Friedrich Ostermann, Anwendungstechnologie Aluminium, Springer-Verlag, Chapter 7 (1998), with English translation.

PTAB—Declaration of Dr. Joseph R. Pickens (*Kaiser Aluminum* v. *Constellium Rolled Products Ravenswood, LLC)*, dated Mar. 26, 2015.

European Standard EN12258-1 (excerpt).

* cited by examiner

THIN SHEETS MADE OF ALUMINIUM-COPPER-LITHIUM ALLOY FOR AIRCRAFT FUSELAGE MANUFACTURE

CROSS-REFERENCE TO RELATED APPLICATIONS

This application is the National Stage entry of International Application No. PCT/FR2019/051269, filed 29 May 2019, which claims priority to France No. 18/55005, filed 8 Jun. 2018.

BACKGROUND

Field

Field of the Invention

The invention relates to rolled aluminium-copper-lithium alloy products, more particularly such products and the methods for manufacture and use thereof, intended in particular for aeronautical and aerospace construction.

Description of Related Art

Rolled products made from aluminium alloy are developed to produce fuselage elements intended in particular for the aeronautical industry and for the aerospace industry.

Aluminium-copper-lithium alloys are particularly promising for manufacturing this type of product.

The U.S. Pat. No. 5,032,359 describes a vast family of aluminium-copper-lithium alloys wherein the addition of magnesium and silver, in particular between 0.3 and 0.5% by weight, increases the mechanical strength.

The U.S. Pat. No. 5,455,003 describes a method for manufacturing Al—Cu—Li alloys that have improved mechanical strength and toughness at cryogenic temperature, in particular by virtue of suitable working and aging. This patent teaches in particular the composition, as a percentage by weight, Cu=2.0-6.5, Li=0.2-2.7, Ag=0-4.0, Mg=0-4.0 and Zn=0-3.0.

The patent EP 0584271 describes an aluminium-based alloy that is useful in aeronautical and aerospace structures, having low density, high strength and high fracture toughness, corresponding essentially to the formula CuaLibMgcAgdZreAlba1, wherein a, b, c, d, e and ba1 indicate the percentage by weight of the alloy compositions, the percentages being $2.4<a<3.5$, $1.35<b<1.8$, $0.25<c<0.65$, $0.25<d<0.65$ and $0.08<e<0.25$.

The U.S. Pat. No. 7,438,772 describes alloys comprising, as a percentage by weight, Cu: 3-5, Mg: 0.5-2, Li: 0.01-0.9 and discourages the use of higher lithium contents because of a degradation in the compromise between toughness and mechanical strength.

The U.S. Pat. No. 7,229,509 describes an alloy comprising (% by weight): (2.5-5.5) Cu, (0.1-2.5) Li, (0.2-1.0) Mg, (0.2-0.8) Ag, (0.2-0.8) Mn, 0.4 max Zr or other agents refining the grain such as Cr, Ti, Hf, Sc, V.

The patent application US 2011/0247730 describes alloys comprising (as % by weight), 2.75 to 5.0% Cu, 0.1 to 1.1% Li, 0.3 to 2.0% Ag, 0.2 to 0.8% Mg, 0.50 to 1.5% Zn, up to 1.0% Mn, with a Cu/Mg ratio of between 6.1 and 17, this alloy having low sensitivity to hot working.

The patent application CN 101967588 describes alloys with the composition (as % by weight) Cu 2.8-4.0; Li 0.8-1.9; Mn 0.2-0.6; Zn 0.20-0.80, Zr 0.04-0.20, Mg 0.20-0.80, Ag 0.1-0.7, Si≤0.10, Fe≤0.10, Ti≤0.12.

The patent FR 3014448 describes a rolled and/or forged product with a thickness of between 14 and 100 mm, made from aluminium alloy with the composition, as % by weight, Cu: 1.8-2.6 Li: 1.3-1.8 Mg: 0.1-0.5 Mn: 0.1-0.5 and Zr<0.05 or Mn<0.05 and Zr 0.10-0.16 10 Ag: 0-0.5 Zn<0.20 Ti: 0.01-0.15 Fe: <0.1 Si: <0.1 15 other elements <0.05 each and <0.15 in total, the remainder aluminium with a density of less than 2.670 g/cm$^3$, characterised in that, halfway through the thickness, the fraction by volume of the grains having a brass texture is between 25 and 40% and the texture index is between 12 and 18.

The patent application US 2009/084474 describes a recrystallised aluminium alloy having a brass texture and a Goss texture, where the brass texture quantity exceeds the Goss texture quantity and where the recrystallised aluminium alloy has at least approximately the same yield strength and the same rupture strength as a non-recrystallised alloy with the same product form and similar thickness and quenching.

The necessary characteristics for aluminium sheets intended for fuselage applications are in particular described for example in the patent EP 1 891 247. It is desirable in particular for the sheet to have a high yield strength (in order to withstand buckling) as well as a high toughness under planar stress, characterised in particular by a high apparent breaking stress intensity factor ($K_{app}$) and a long R curve.

The patent EP 1 966 402 describes an alloy comprising 2.1 to 2.8% by weight Cu, 1.1 to 1.7% by weight Li, 0.1 to 0.8% by weight Ag, 0.2 to 0.6% by weight Mg, 0.2 to 0.6% by weight Mn, a quantity of Fe and Si less than or equal to 0.1% by weight each, and unavoidable impurities to an extent of less than or equal to 0.05% by weight each and 0.15% by weight in total, the alloy being substantially free from zirconium, particularly suitable for obtaining recrystallised thin sheets.

For some fuselage applications, it is particularly important for the toughness to be high in the T-L direction. This is because a major part of the fuselage is sized to withstand the internal pressure of the aircraft. Since the longitudinal direction of the sheets is in general positioned in the direction of the length of the aircraft, they are stressed in the transverse direction by the pressure. The cracks are then stressed in the T-L direction. It may also be advantageous for the sheets to have low anisotropy of mechanical-properties, in particular between the L and TL directions.

It is known from the patent EP 1 891 247 that, for sheets with a thickness of between 4 and 12 mm, it may be advantageous for the microstructure to be completely non-recrystallised. However, the effect of the granular structure on the properties may be different at different thicknesses.

There exists a need for thin sheets, with a thickness of 0.5 to 8 mm, made from aluminium-copper-lithium alloy having improved properties compared with those of known products, in particular in terms of toughness in the T-L direction, with properties of static mechanical strength and corrosion resistance, while having low density and low anisotropy of mechanical properties. Moreover, there exists a need for a simple and economical method for obtaining such thin sheets.

SUMMARY

One object of the invention is a method for manufacturing a thin sheet with a thickness of 0.5 to 8 mm from an aluminium-based alloy wherein, successively a) a liquid metal bath is produced, comprising
2.3 to 2.7% by weight Cu,
1.3 to 1.6% by weight Li,
0.2 to 0.5% by weight Mg,
0.1 to 0.5% by weight Mn,
0.01 to 0.15% by weight Ti,
a quantity of Zn of less than 0.3% by weight, a quantity of Fe and Si of less than or equal to 0.1% by weight each, and unavoidable impurities with a content of less than or equal to 0.05% by weight each and 0.15% by weight in total, b) a plate is cast from said liquid metal bath;

c) said plate is homogenised at a temperature of between 490° C. and 535° C.;

d) said plate is rolled by hot rolling and optionally by cold rolling into a sheet having a thickness of between 0.5 and 8 mm, the entry temperature of the hot rolling being between 400° C. and 445° C. and the exit temperature of the hot rolling being less than 300° C.;

e) it is solution heat treated at a temperature of between 450° C. and 515° C. and said sheet is quenched;

f) said sheet is stretched in a controlled manner with a permanent deformation of 0.5 to 6%, the cold deformation after solution heat treatment being less than 15%;

g) aging is carried out, comprising heating at a temperature of between 130° and 170° C. and preferably between 150° and 160° C. for 5 to 100 hours and preferably 10 to 40 h.

Another object of the invention is a sheet obtained by the method according to the invention, wherein the mean grain size in the thickness measured by the intercepts method on an L/TC section in the L direction in accordance with ASTM E112 and expressed in μm is less than 66 t+200, where t is the thickness of the sheet expressed in mm.

Yet another object of the invention is the use of a thin sheet according to the invention in a fuselage panel for an aircraft.

DETAILED DESCRIPTION OF A PREFERRED EMBODIMENT

Figure 1:
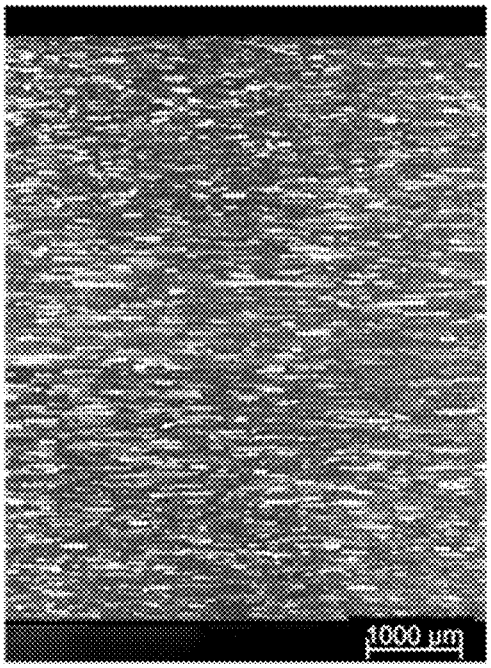
FIG. 1: Metallographic section of the sheet A-1.

Unless mentioned to the contrary, all the indications relating to the chemical composition of the alloys are expressed as a percentage by weight based on the total weight of the alloy. The expression 1.4 Cu means that the copper content expressed as a % by weight is multiplied by 1.4. The alloys are designated in conformity with the rules of the Aluminium Association, known to persons skilled in the art. The density is dependent on the composition and is determined by calculation rather than by a weight-measurement method. The values are calculated in accordance with the procedure of the Aluminium Association that is described on pages 2-12 and 2-13 of "Aluminium Standards and Data". Unless mentioned otherwise, the definitions of the metallurgical states indicated in the European standard EN 515 (1993) apply.

The static tensile mechanical characteristics, in other words the ultimate tensile strength $R_m$, the conventional yield strength at 0.2% of elongation $R_{p0.2}$, and the elongation at rupture A %, are determined by a tensile test in accordance with NF EN ISO 6892-1 (2016), the sampling and the direction of the test being defined by EN 485-1 (2016). In the context of the invention, the mechanical characteristics are measured in full thickness.

A curve giving the effective stress intensity factor as a function of the effective crack extension, known as the R curve, is determined in accordance with ASTM E 561. The critical stress intensity factor $K_C$, in other words the intensity factor that makes the crack unstable, is calculated from the R curve. The stress intensity factor $K_{CO}$ is also calculated by attributing the initial crack length at the commencement of the monotonic load, to the critical load. These two values are calculated by a test piece of the required form. $K_{app}$ represents the factor $K_{CO}$ corresponding to the test piece that was used for carrying out the R curve test. $K_{eff}$ represents the $K_C$ factor corresponding to the test piece that was used for carrying out the R curve test. $K_{R60}$ represents the stress intensity factor corresponding to the crack extension $\Delta a_{eff}$=60 mm. $\Delta a_{eff}$(max) represents the crack extension of the last point on the R curve, valid in accordance with ASTM E561. The last point is obtained either at the moment of the abrupt rupture of the test piece, or optionally at the moment when the stress on the non-cracked ligament exceeds on average the yield strength of the material. Unless mentioned to the contrary, the crack size at the end of the fatigue pre-cracking stage is W/3 for test pieces of the M(T) type, wherein W is the width of the test piece as defined in ASTM E561 (ASTM E561-10-2).

Unless otherwise mentioned, the definitions in EN 12258 (2012) apply.

In the context of the present invention, an essentially recrystallised granular structure means a granular structure such that the degree of recrystallisation at half thickness is greater than 70% and preferably greater than 90%. The degree of recrystallisation is defined as the fraction of surface on a metallographic section occupied by recrystallised grains.

The present inventors have obtained sheets with a thickness of 0.5 to 8 mm having an advantageous compromise between mechanical strength and toughness using the method according to the invention, which comprises in particular the combination of a narrow selection of the composition, deformation by hot rolling under strictly controlled conditions.

The thin sheets thus obtained have particularly advantageous properties, in particular with regard to the toughness of the T-L direction and the anisotropy of the mechanical properties.

In the method according to the invention, a bath of liquid metal is produced, the composition of which is as follows:

2.3 to 2.7% by weight Cu,
1.3 to 1.6% by weight Li,
0.2 to 0.5% by weight Mg,
0.1 to 0.5% by weight Mn,
0.01 to 0.15% by weight Ti,
a quantity of Zn of less than 0.3% by weight, a quantity of Fe and Si of less than or equal to 0.1% by weight each, and unavoidable impurities with a content of less than or equal to 0.05% by weight each and 0.15% by weight in total.

The copper content of the products according to the invention is between 2.3 and 2.7% by weight. In an advantageous embodiment of the invention, the copper content is at least 2.4% by weight, preferably at least 2.45% by weight and preferentially at least 2.50% by weight. In an advantageous embodiment, the copper content is between 2.45 and 2.65% by weight and preferably between 2.50 and 2.60% by weight. In an advantageous embodiment of the invention, the copper content is no more than 2.65% by weight and preferentially no more than 2.60% by weight. In one embodiment of the invention the copper content is no more than 2.53% by weight. When the copper content is too high, a very high toughness value in the T-L direction may not be achieved. When the copper content is too low, the minimum static mechanical characteristics are not achieved.

The lithium of the products according to the invention is between 1.3 and 1.6% by weight. Advantageously, the lithium content is between 1.35 and 1.55% by weight and preferably between 1.40% and 1.50% by weight. A minimum lithium content of 1.35% by weight and preferably 1.40% by weight is advantageous. A maximum lithium content of 1.55% by weight and preferably 1.50% by weight is advantageous, in particular in order to improve the compromise between toughness and mechanical strength. The addition of lithium may contribute to an increase in the mechanical strength and toughness, an excessively high or excessively low content does not make it possible to obtain a very high toughness value in the T-L direction and/or a sufficient elastic limit. Moreover, adding lithium reduces the density. Advantageously, the density of the products according to the invention is less than 2.65.

The magnesium content of the products according to the invention is between 0.2 and 0.5% by weight and preferably between 0.25 and 0.45% by weight and preferably between 0.25 and 0.35% by weight. A minimum magnesium content of 0.25% by weight is advantageous. A maximum magnesium content of 0.45% by weight and preferably 0.40% by weight and preferentially 0.35% by weight or even 0.30% by weight is advantageous. The manganese content is between 0.1 and 0.5% by weight, preferably between 0.2 and 0.4% by weight and preferentially between 0.25 and 0.35% by weight. A minimum manganese content of 0.2% by weight and preferably 0.25% by weight is advantageous. A maximum manganese content of 0.4% by weight and preferably 0.35% by weight or even 0.33% by weight is advantageous.

The titanium content is between 0.01 and 0.15% by weight. Adding titanium, optionally combined with boron and/or carbon, helps to control the granular structure, in particular during casting.

Preferably, the iron and silicon contents are each no more than 0.1% by weight. In an advantageous embodiment of the invention the iron and silicon contents are no more than 0.08% and preferentially no more than 0.04% by weight. A controlled and limited iron and silicon content helps to improve the compromise between mechanical strength and tolerance to damage.

The zinc content is less than 0.3% by weight, preferentially less than 0.2% by weight and preferably less than 0.1% by weight. The zinc content is advantageously less than 0.04% by weight.

Unavoidable impurities are maintained at a proportion less than or equal to 0.05% by weight each and 0.15% by weight in total.

The method for manufacturing thin sheets according to the invention next comprises steps of casting, homogenisation, hot rolling and optionally cold rolling, solution heat treatment, controlled stretching, quenching and aging.

The liquid-metal bath produced is cast in the form of a plate for rolling.

The plate for rolling is next homogenised at a temperature of between 490° C. and 535° C. Preferably, the duration of homogenisation is between 5 and 60 hours. Advantageously, the homogenisation temperature is at least 500° C. In one embodiment, the homogenisation temperature is below 515° C.

After homogenisation, the rolling plate is in general cooled to ambient temperature before being preheated with a view to being deformed hot. The objective of the preheating is to achieve an entry temperature to hot rolling of between 400 and 450° C. and preferably between 420° C. and 440° C., allowing deformation by hot rolling.

The hot rolling is carried out so as to obtain a sheet with a thickness of typically 4 to 8 mm. The exit temperature of the hot rolling is less than 300° C. and preferably less than 290° C. The specific hot-rolling conditions in combination with the composition according to the invention make it possible in particular to obtain an advantageous compromise between mechanical strength and toughness and low anisotropy of the mechanical properties.

After hot rolling, it is optionally possible to cold roll the sheet obtained, in particular in order to obtain a final thickness of between 0.5 and 3.9 mm. Preferentially, the final thickness is no more than 7.0 mm and preferably no more than 6.0 mm. Advantageously, the final thickness is at least 0.8 mm and preferably at least 1.2 mm.

The sheet thus obtained is next solution heat treated between 450 and 515° C. The duration of solution heat treatment is advantageously between 5 min and 8 h. The sheet thus solution heat treated is next quenched.

It is known to a person skilled in the art that the aforementioned conditions of solution heat treatment must be chosen according to the thickness and the composition so as to put the hardening elements in solid solution.

The sheet next undergoes cold deformation by controlled stretching with a permanent deformation of 0.5 to 6% and preferentially 3 to 5%. Known steps such as rolling, flattening and shaping can optionally be performed after solution heat treatment and quenching and before or after controlled stretching, however total cold deformation after solution heat treatment and quenching must remain below 15% and preferably below 10%. High cold deformations after solution heat treatment and quenching in fact cause the appearance of numerous shearing bands passing through several grains, these shearing bands not being desirable. Preferably cold rolling is not carried out after the solution heat treatment.

Aging is carried out, comprising heating at a temperature of between 130 and 170° C. and preferably between 140 and 160° C. and preferably between 145 and 155° C. for 5 to 100 hours and preferably from 10 to 40 h. Preferably, the final metallurgical state is a T8 state. In one embodiment of the invention, a short heat treatment is carried out after controlled stretching and before aging so as to improve the shapeability of the sheets. The sheets may be shaped by a method such as drawing-forming before being annealed.

The thin sheets obtained by the method according to the invention have a characteristic grain size. Thus the mean grain size in the thickness measured by the intercept method on an L/TC section in the L direction in accordance with ASTM E112 and expressed in μm is less than 66 t+200 where t is the thickness of the sheet expressed in mm, preferably less than 66 t+150 and preferably less than 66 t+100, for the thin sheets obtained by the method according to the invention. The granular structure of the sheets is advantageously essentially recrystallised.

The thin sheets obtained by the method according to the invention have a particularly advantageous toughness in the T-L direction. In particular, the thin sheets obtained by the method according to the invention advantageously have an yield strength $R_{p0.2}$ in the TL direction of at least 370 MPa, preferentially at least 380 MPa and preferably at least 390 MPa, and a plane strain fracture toughness $K_{R60}$, measured on test pieces of the CCT760 type (2ao=253 mm), of at least 170 MPa√m, preferentially at least 175 MPa√m and preferably at least 180 MPa√m.

The most favourable performances of the sheets according to the invention, in particular for a thickness of between 2 mm and 7 mm, namely an yield strength $R_{p0.2}$ in the TL direction of at least 393 MPa, a plane strain fracture toughness $K_{R60}$, measured on test pieces of the CCT760 type (2ao=253 mm), in the T-L direction of at least 180 MPa √m are in particular obtained when the lithium content is between 1.40 and 1.50% by weight, the copper content is between 2.45 and 2.55% by weight and the magnesium content is between 0.25 and 0.35% by weight.

The sheets according to the invention also have low anisotropy. Thus the ratio between the difference in yield strength between the L and TL directions and the yield strength in the L direction is less than 6% and preferably less than 5%.

The resistance to intergranular corrosion of the sheets according to the invention is high. In a preferred embodiment of the invention, the sheet of the invention can be used without plating.

The use of thin sheets according to the invention in a fuselage panel for an aircraft is advantageous. The thin sheets according to the invention are also advantageous in aerospace applications such as the manufacture of rockets.

EXAMPLE

In this example, eight thin sheets were prepared.

Alloys the composition of which is given in Table 1 were cast:

TABLE 1

| | Composition (% by weight) | | | | | | | |
|---|---|---|---|---|---|---|---|---|
| | Cu | Li | Mg | Mn | Ti | Fe | Si | Zn |
| A | 2.51 | 1.43 | 0.28 | 0.30 | 0.03 | 0.04 | 0.03 | <0.01 |
| B | 2.56 | 1.54 | 0.26 | 0.30 | 0.04 | 0.04 | 0.03 | <0.01 |
| C | 2.52 | 1.46 | 0.35 | 0.36 | 0.04 | 0.04 | 0.03 | <0.01 |
| D | 2.59 | 1.46 | 0.34 | 0.36 | 0.04 | 0.04 | 0.02 | <0.01 |

The plates were transformed in accordance with the parameters indicated in Table 2. The transformation conditions used for the sheets made from A-1, A-2, B-1 and B-2 alloy are in accordance with the invention. The aging conditions were defined so as to obtain a T8 state.

TABLE 2

| Transformation parameters of the sheets | | | | | | | | |
|---|---|---|---|---|---|---|---|---|
| Sheet | A-1 | A-2 | B-1 | B-2 | C-1 | C-2 | D-1 | D-2 |
| Composition | A | A | B | B | C | C | D | D |
| Homogenisation | 12 h 505° C. | 12 h 505° C. | 12 h 505° C. | 12 h 505° C. | 12 h 505° C. | 12 h 505° C. | 12 h 505° C. | 12 h 505° C. |
| Hot rolling entry temperature (° C.) | 434 | 430 | 430 | 432 | 452 | 451 | 447 | 448 |
| Hot rolling exit temperature (° C.) | 250 | 280 | 269 | 273 | 313 | 338 | 309 | 320 |
| Cold rolling | No | No | Yes | No | Yes | No | Yes | No |
| Final thickness (mm) | 6.4 | 4.0 | 1.6 | 4.0 | 3.2 | 6.4 | 2.2 | 4.0 |
| Solution heat treatment | 40 min at 500° C. | 30 min at 500° C. | 10 min at 500° C. | 30 min at 500° C. | 20 min at 500° C. | 40 min at 500° C. | 20 min at 500° C. | 30 min at 500° C. |
| Stretch | 4.1 to 4.5% | 4.0 to 4.7% | 4.5 à 4.9% | 4.4 to 4.6% | 4.2 to 4.6% | 4.1 to 4.3% | 3.8 to 4.6% | 3.5 to 4.3% |
| Aging | 34 h at 155° C. | 34 h at 155° C. | 34 h at 155° C. | 34 h at 155° C. | 28 h at 155° C. | 28 h at 155° C. | 28 h at 155° C. | 28 h at 155° C. |

Figure 2:
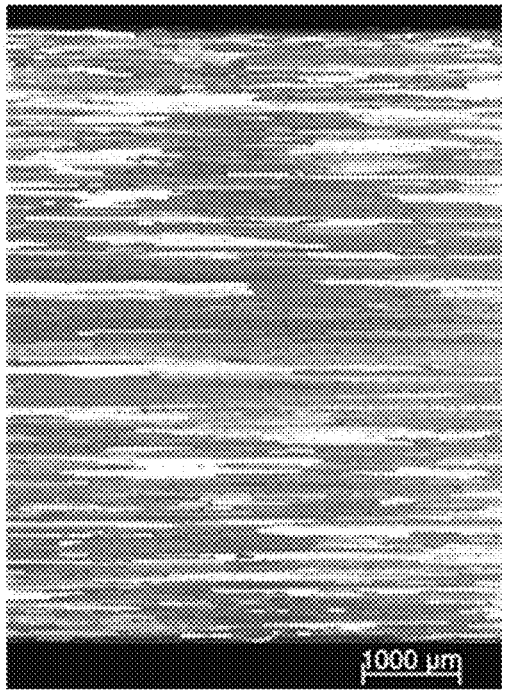
FIG. 2: Metallographic section of the sheet C-2.
Figure 3:
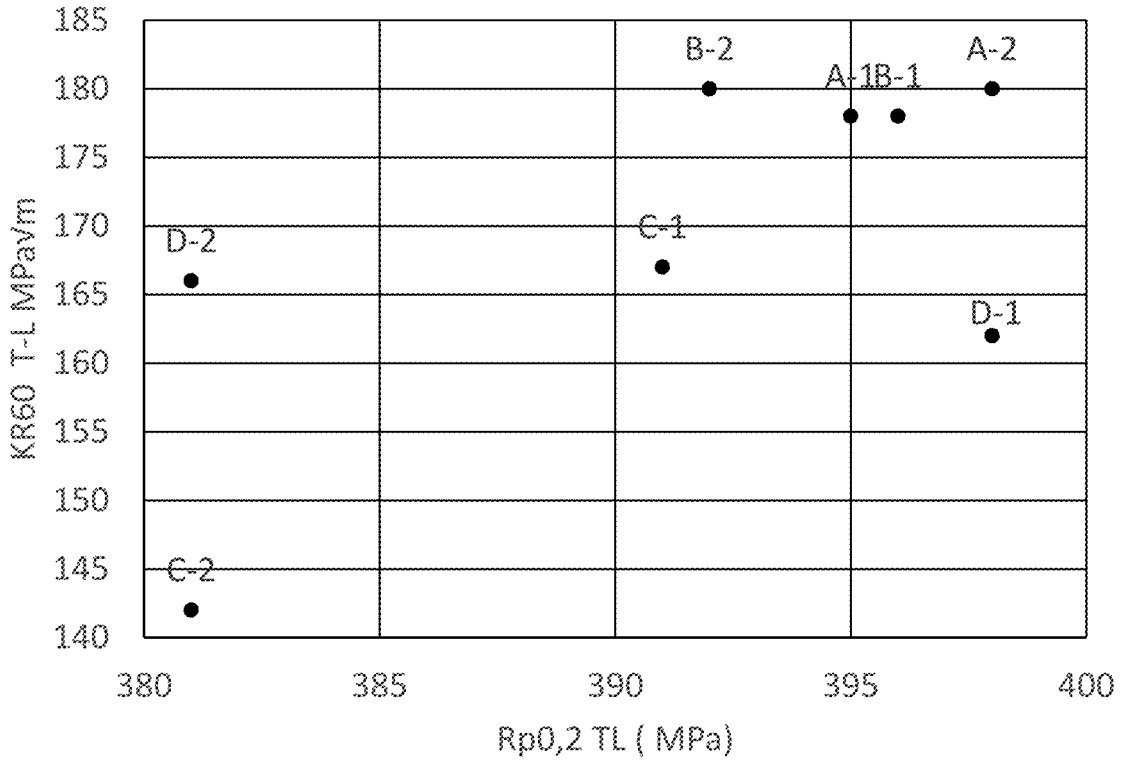
FIG. 3: Relationship between the yield strength in the TL direction and the KR60 T-L stress intensity factor measured on samples with a width of 760 mm for the sheets of example 1.

The granular structure of the samples was characterised using microscope observation of the cross sections after anodic oxidation, under polarised light on L/TC sections. The microstructures observed for samples A-1 and C-2 are presented in FIGS. 1 and 2 respectively. The granular structure of the sheets was essentially recrystallised. The mean grain sizes in the thickness measured by the intercepts method in accordance with ASTM E112 are presented in Table 3.

TABLE 3

| Grain sizes measured on L/TC sections | | | |
|---|---|---|---|
| | Grain size | | |
| Sheet | L (μm) | TC (μm) | Aspect ratio |
| A-1 | 194 | 28 | 7 |
| A-2 | 339 | 34 | 10 |
| B-1 | 194 | 41 | 5 |
| B-2 | 337 | 31 | 11 |
| C-1 | 506 | 45 | 11 |
| C-2 | 813 | 45 | 19 |
| D-1 | 542 | 56 | 8 |
| D-2 | 545 | 47 | 12 |

The samples were tested mechanically in order to determine the static mechanical properties thereof as well as the resistance thereof to the propagation of cracks. The tensile yield strength, the ultimate tensile strength and the elongation at rupture are set out in Table 4.

TABLE 4

Mechanical characteristics expressed in MPa ($R_{p0.2}$, $R_m$) and as a percentage (A %)

| Sheet | $R_{p0.2}$ (L) | $R_m$ (L) | A % (L) | $R_{p0.2}$ (TL) | $R_m$ (TL) | A % (TL) | $R_{p0.2}$ (45°) | $R_m$ (45°) | A % (45°) |
|---|---|---|---|---|---|---|---|---|---|
| A-1 | 415 | 444 | 12.2 | 395 | 445 | 12.6 | 393 | 439 | 13.1 |
| A-2 | 415 | 440 | 13.3 | 398 | 447 | 12.7 | 398 | 440 | 13.0 |
| B-1 | 402 | 426 | 13.0 | 396 | 446 | 12.3 | 385 | 429 | 13.2 |
| B-2 | 405 | 434 | 12.8 | 392 | 443 | 11.5 | 388 | 435 | 11.8 |
| C-1 | 414 | 442 | 13.1 | 391 | 463 | 11.9 | 381 | 446 | 13.7 |
| C-2 | 401 | 435 | 13.6 | 381 | 450 | 10.2 | 374 | 437 | 13.7 |
| D-1 | 410 | 438 | 11.0 | 398 | 465 | 9.6 | 385 | 444 | 12.4 |
| D-2 | 400 | 434 | 12.6 | 381 | 451 | 10.0 | 389 | 446 | 12.1 |

Table 5 summarises the results of the toughness tests for these samples.

TABLE 5

Results of the R curves for the test pieces of width 760 mm.

| | $K_R$app [MPa√m] | | KR60 [MPa√m] | | Valid max $\Delta a_{eff}$ [mm] | |
|---|---|---|---|---|---|---|
| Sheet | T-L | L-T | T-L | L-T | T-L | L-T |
| A-1 | 135 | 161 | 181 | 213 | 82 | 108 |
| A-2 | 140 | 168 | 187 | 222 | 134 | 85 |
| B-l | 135 | 154 | 178 | 206 | 103 | 109 |
| B-2 | 135 | 163 | 180 | 216 | 148 | 84 |
| C-l | 126 | 155 | 167 | 208 | 140 | 120 |
| C-2 | 110 | 157 | 142 | 208 | 83 | 100 |
| D-l | 124 | 152 | 162 | 201 | 187 | 128 |
| D-2 | 126 | 158 | 166 | 210 | 131 | 97 |

The invention claimed is:

1. A method for manufacturing a thin sheet with a thickness of 4 to 8 mm from an aluminum-based alloy wherein, successively a) a liquid metal bath is produced, comprising
2.3 to 2.7% by weight Cu,
1.3 to 1.6% by weight Li,
0.2 to 0.5% by weight Mg,
0.1 to 0.5% by weight Mn,
0.01 to 0.15% by weight Ti,
a quantity of Zn of less than 0.3% by weight, a quantity of Fe and Si of less than or equal to 0.1% by weight each, and unavoidable impurities with a content of less than or equal to 0.05% by weight each and 0.15% by weight in total, and a remainder Al, b) a plate is cast from said liquid metal bath;

c) said plate is homogenized at a temperature of between 490° C. and 535° C.;

d) said plate is rolled by hot rolling into a sheet having a thickness of between 4 and 8 mm, the entry temperature of the hot rolling being between 420° C. and 445° C. and the exit temperature of the hot rolling being between 250° C. and 290° C.;

e) said sheet is solution heat treated at a temperature of between 450° C. and 515° C. and said sheet is quenched;

f) said sheet is stretched in a controlled manner with a permanent deformation of 0.5 to 6%, total cold deformation after solution heat treatment and quenching being less than 15%;

g) aging is carried out, comprising heating at a temperature of between 130° and 170° C. for 5 to 100 hours.

2. The method according to claim 1, wherein the copper content is between 2.45 and 2.65% by weight.

3. The method according to claim 1, wherein the lithium content is between 1.35 and 1.55% by weight.

4. The method according to claim 1, wherein the magnesium content is between 0.25 and 0.45% by weight.

5. The method according to claim 1, wherein the manganese content is between 0.2 and 0.4% by weight.

6. The method according to claim 1, wherein the zinc content is less than 0.1% by weight.

7. The method according to claim 1, wherein the hot-rolling entry temperature is between 420° C. and 440° C. and/or the hot-rolling exit temperature is between 250° C. and 280° C.

8. The method according to claim 1, wherein the liquid metal bath comprises:
2.45 to 2.65% by weight Cu,
1.35 to 1.55% by weight Li,
0.25 to 0.45% by weight Mg,
0.2 to 0.4% by weight Mn,
0.01 to 0.15% by weight Ti,
a quantity of Zn of less than 0.3% by weight, a quantity of Fe and Si of less than or equal to 0.1% by weight each, and unavoidable impurities with a content of less than or equal to 0.05% by weight each and 0.15% by weight in total, and a remainder Al.

9. The method according to claim 8, wherein the liquid metal bath comprises:
2.50 to 2.60% by weight Cu,
1.40 to 1.50% by weight Li,
0.25 to 0.35% by weight Mg,
0.25 to 0.35% by weight Mn,
0.01 to 0.15% by weight Ti,
a quantity of Zn of less than 0.3% by weight, a quantity of Fe and Si of less than or equal to 0.1% by weight each, and unavoidable impurities with a content of less than or equal to 0.05% by weight each and 0.15% by weight in total, and a remainder Al.

10. The method according to claim 1, wherein the hot-rolling exit temperature is between 269° C. and 280° C.

11. The method according to claim 1, wherein the thin sheet has a yield strength $R_{p0.2}$ in the TL direction of at least 370 MPa, and a plane strain fracture toughness $K_{R60}$, measured on test pieces of the CCT760 type (2ao=253 mm), of at least 170 MPa √m in the T-L direction and in the L-T direction.

12. The method according to claim 1, wherein g) aging is carried out, comprising heating at a temperature of between 150° C. and 160° C. for 10 to 40 h.

* * * * *